US009271574B2

(12) United States Patent
Hortig et al.

(10) Patent No.: US 9,271,574 B2
(45) Date of Patent: Mar. 1, 2016

(54) FITTING FOR AN ITEM OF SEATING FURNITURE

(71) Applicants: Andreas Hortig, Halle (DE); Boris Besler, Guetersloh (DE)

(72) Inventors: Andreas Hortig, Halle (DE); Boris Besler, Guetersloh (DE)

(73) Assignee: KINTEC-SOLUTION GMBH, Rietberg (DE)

( * ) Notice: Subject to any disclaimer, the term of this patent is extended or adjusted under 35 U.S.C. 154(b) by 18 days.

(21) Appl. No.: 13/960,948

(22) Filed: Aug. 7, 2013

(65) Prior Publication Data

US 2014/0049078 A1 Feb. 20, 2014

(30) Foreign Application Priority Data

Aug. 15, 2012 (DE) ..... 10 2012 214 541

(51) Int. Cl.

| | |
|---|---|
| ***A47C 1/03*** | (2006.01) |
| ***A47C 1/034*** | (2006.01) |
| ***A47C 1/0355*** | (2013.01) |
| ***A47C 1/035*** | (2006.01) |
| ***A47C 1/032*** | (2006.01) |

(52) U.S. Cl.

CPC ..... *A47C 1/034* (2013.01); *A47C 1/035* (2013.01); *A47C 1/0355* (2013.01); *A47C 1/03272* (2013.01)

(58) Field of Classification Search

CPC ... A47C 1/03272; A47C 1/035; A47C 1/0355
USPC ..... 297/68, 83, 84, 316, 423.26, 423.28, 297/423.3

See application file for complete search history.

(56) References Cited

U.S. PATENT DOCUMENTS

| | | | | |
|---|---|---|---|---|
| 264,754 | A * | 9/1882 | Redeker | A47C 1/06 297/229 |
| 3,121,589 | A * | 2/1964 | Schliephacke | A47C 1/035 297/84 |
| 3,322,459 | A * | 5/1967 | Hampton | A47C 1/0355 297/259.2 |
| 3,947,067 | A * | 3/1976 | Griefahn | A47C 1/0355 297/316 |
| 5,918,942 | A * | 7/1999 | Olsen | A47C 1/035 297/321 |
| 6,692,068 | B1 * | 2/2004 | Tang | A47C 1/035 297/16.2 |
| 7,273,257 | B2 * | 9/2007 | De Vroe | A47C 1/035 297/330 |
| 2005/0035632 | A1 * | 2/2005 | Tseng | A47C 1/0355 297/83 |
| 2007/0126267 | A1 * | 6/2007 | Hoffman | A47C 1/0355 297/84 |
| 2010/0072805 | A1 * | 3/2010 | Qiu | A47C 1/0355 297/85 R |

(Continued)

FOREIGN PATENT DOCUMENTS

| | | |
|---|---|---|
| DE | 20 2005 006 216 U1 | 7/2005 |
| DE | 10 2005 051 236 A1 | 10/2006 |
| EP | 2 356 922 A1 | 8/2011 |

OTHER PUBLICATIONS

Office Action of German Patent Office issued in German Application No. 10 2012 214 541.9 dated Jun. 5, 2013 (5 pages).

(Continued)

*Primary Examiner* — Ryan Kwiecinski

(74) *Attorney, Agent, or Firm* — Flynn, Thiel, Boutell & Tanis, P.C.

(57) ABSTRACT

A fitting for an item of seating furniture and item of seating furniture.

The fitting includes a pivotable leg support segment, wherein the fitting has a separate spring which serves to secure the leg support segment in a storage position while not being used.

17 Claims, 5 Drawing Sheets

(56) References Cited

U.S. PATENT DOCUMENTS

2010/0127538 A1* 5/2010 Hoffman ..... A47C 1/0355 297/68
2013/0257110 A1* 10/2013 Fischer ..... A47C 1/0355 297/83
2013/0341974 A1* 12/2013 Ishikawa ..... A47C 7/506 297/68
2014/0049078 A1* 2/2014 Hortig ..... A47C 1/034 297/68
2014/0239675 A1* 8/2014 Besler ..... A47C 1/035 297/68
2014/0291950 A1* 10/2014 Hough ..... A61G 5/14 280/47.4
2014/0300145 A1* 10/2014 Beroth ..... B64D 11/06 297/83
2014/0333111 A1* 11/2014 Besler ..... A47C 1/035 297/423.26

OTHER PUBLICATIONS

Form PCT/ISA/220 for Application No. PCT/EP2013/063850 dated Oct. 18, 2013 (1 page).
Form PCT/ISA/210 for Application No. PCT/EP2013/063850 dated Oct. 18, 2013 with English Translation of Categories of Cited Documents (4 pages).
Form PCT/ISA/237 for Application No. PCT/EP2013/063850 dated Oct. 18, 2013 (5 pages).

* cited by examiner

FITTING FOR AN ITEM OF SEATING FURNITURE

FIELD OF APPLICATION AND PRIOR ART

This application claims the priority of the German patent application No. 10 2012 214 541.9. The whole disclosure of this prior application is herewith incorporated by reference into this application.

The invention relates to a fitting for an item of seating furniture and to an item of seating furniture having such a fitting.

Such a fitting for an item of seating furniture comprises the following components: It has a base for a fixed in position arrangement or an arrangement rotatably movable around a vertical axis on a ground. It comprises a support part to which the seating surface of the item of seating furniture is attached according to the designated purpose, wherein said support part is movable relative to the aforementioned base between a front end relative position and a rear end relative position with respect to a furniture longitudinal axis. For the purpose of said relative movability of the support part, it comprises furthermore a front and a rear rigid bracket, wherein the front bracket is pivotable relative to the base about a first axis fixed in position to the base and to the first bracket and relative to the support part about a second axis fixed in position to the support part and the front bracket. The rear bracket is pivotable relative to the base about a third axis fixed in position to the base and to the rear bracket and relative to the support part about a fourth axis fixed in position to the support part and the rear bracket. Furthermore, the fitting comprises a leg support part for attaching a leg support, which part can be pivoted between a storage position underneath the base and a functional position in front of the base and the relative position thereof to the base is forcedly-coupled to the relative position of the support part relative to the base such that the leg support part takes the functional position when the support part is arranged in its rear end relative position and takes the storage position when the support part is arranged in its front end relative position.

Furthermore, such a fitting also comprises a first spring between a first and a second coupling point at the support part and the base part, which spring causes a force application to the support part in the direction of its front end position.

Such items of furniture are known at least from the internal prior art. The base is that part which is preferably arranged fixed in position and, at the most, rotatably on a ground, i.e. a floor area. According to the invention, it is connected to a furniture foot or comprises said foot. The support part, which in the assembled state of the fitting supports the seating surface, is movable relative to the base, wherein that is effected via the aforementioned front and rear bracket. In this case, usually provision is made for in each case a plurality of front and rear brackets, which are pivotable around identical pivot axis. As far as reference is made to the front or to the rear bracket, respectively, in connection with the present document, that shall also refer to a plurality of such brackets.

By means of the support part, the base and the front and the rear bracket, a system of four segments is formed, which in a closed catenary are movable relative to one another due to the four axes parallel to one another. Said movability serves to displace the support part of the seating surface backwards if a person sits on the respective item of seating furniture. Said displacement of the support part backwards is connected to a displacement of the aforementioned leg support part, which as a result is pivoted from a storage position into the functional position. The aforementioned catenary of four segments results in that the base part can only move along a defined path relative to the base. To each position of the support part is assigned a pivot angle of the support part determined by the length of the brackets.

The first spring which is usually present in such items of furniture and which is preferably also present in the item of seating furniture according to the invention and the fitting thereof pushes the support part in the direction of its front end relative position, what pushes the leg support part in the direction of its storage position due to the forced coupling to the leg support part. Said spring serves to dampen the displacement of the support part from its front end relative position into its rear end relative position, when in particular a heavy person sits on the respective item of seating furniture. Said spring usually provided in items of furniture known from the prior art is generally configured comparatively softly.

Although said spring generally acts in such a way that the support part is pushed in the direction of its front end relative position and as a result the leg support part is pushed in the direction of its storage position, said spring is not sufficient to keep the leg support part reliably in the storage position. Especially if said leg support part is provided with a massive upholstering, the first spring cannot ensure a reliable reaching of the storage position.

In the abovementioned prior art known at least internally it is provided that exterior to the fitting, that is to say exterior to the left and right side walls of the base part, further springs are provided, which act between base and leg support part and which pull the leg support part continuously into the direction of its storage position, wherein in the course of the transfer of the leg support part into its functional position, a dead center position is surpassed so that said springs are also suitable to secure the functional position of the leg support part.

However, the problem regarding such known springs is that they would be very much expanded in the case of great pivot angles of the leg support part, so that expansion forces would be required in order to ensure the desired functioning, which at the same time would cause a sluggishness in the transfer of the leg support part into its functional position. Furthermore, the aforementioned springs usually provided externally of the side walls are problematic since they are arranged almost horizontally just as the first spring and thus need to be adjusted specifically to the first spring. In the case of a change of individual components of the fitting or of the furniture comprising the fitting, significant adjustments would be required. Thus, for example, a change of the upholstering and of the weight of the upholstering can result in that the first spring or the known additional springs acting on the leg support need to be re-configured.

Object and Solution

Thus, the object of the invention is to develop such a furniture fitting further such that said fitting is capable of securing the leg support segment in its storage position.

According to the invention, that is achieved in that a second spring is provided which on the one hand is coupled to a third coupling point, which is spaced apart from the first coupling point and the second coupling point, at the support part and on the other hand to a fourth coupling point at the base part and which spring acts between the support part and the base part, when the leg support part approaches its storage position, such that the leg support part is applied with a force into the direction of its storage position.

Thus, according to the invention, besides the first spring which is to effect the above described dampening effect, a second spring specifically provided therefor is to be attached to the fitting, which second spring serves for securing the storage position of the leg support part. Said spring is to be attached to coupling points differing from the coupling points of the first spring and thus acts geometrically different. In contrast to known designs, it does not directly act on the leg support part but between the base part and the support part and uses the forced coupling of their relative position to the position of the leg support part. As a result of such a specific second spring, which can be arranged such that it causes a relevant effect only in the region of the storage position of the leg support part by means of measures yet to be explained in the following, the storage position of the leg support part can reliably be secured.

The second spring is preferably provided in a front region of the fitting, i.e. in the region of the front bracket. At said front part also the leg support part is provided, which is preferably connected such that it is always pivoted together with the front bracket in the same direction.

It is particularly advantageous if the second spring is arranged such that it causes the desired effect when the leg support part approaches the storage position, but that it does not cause an adverse effect and in particular preferably performs energetically almost neutral if the leg support part has a greater distance to its storage position.

It turned out that this can be achieved when the distance of the coupling points of the second spring relative to the first and the second axis are subject to certain principles.

Thus, it is particularly advantageous when the third coupling point of the second spring, i.e. the coupling point at the base part, is spaced apart from the second axis, i.e. the pivot axis of the front bracket. Preferably, said spacing is between 5 mm and 50 mm. In analogy, with respect to the fourth coupling point of the second spring, i.e. the coupling point of the base, and the first axis, i.e. the base-sided axis of the front bracket, it is provided that here a spacing is provided which is preferably between 5 mm and 40 mm.

In connection with said geometric data, the following information is relevant for a better understanding: The measures according to the invention can well be explained by means of an analysis of the fitting as a two-dimensional fitting. Unless otherwise provided in the following, the respective indications regarding the spacing of axis and coupling points refer to a projection of the fitting to a plane which is spanned by the furniture vertical direction and the furniture longitudinal direction. The aforementioned axes extend in the furniture transverse direction, i.e. orthogonally to said projection plane.

By means of the proposed spacing between the first axis and the fourth coupling point and between the second axis and the third coupling point it is achieved that the indirect effect of the second spring on the leg support part can change over the pivot distance between the storage position and the functional position. However, by means of the but small spacing, it is achieved that the second spring during the aforementioned transfer from the storage position of the leg support part to the functional position is only slightly expanded, which is advantageous with respect to the simple arrangeability of the second spring.

In order to achieve the effectiveness of the spring in a particularly advantageous manner, when the leg support part is close to its storage position, and in order to achieve the neutralization of the second spring, when the distance of the leg support part to its storage position is comparatively great, the relative arrangement of the third and of the fourth coupling point as well as of the first and second axes can advantageously be configured as follows.

Firstly, it is advantageous if a first connection straight in the aforementioned projection plane, which extends between the first axis and the second axis, includes an angle with a second connection straight extending between the third and the fourth coupling point that is greater in the front end relative position of the support part and thus in the storage position of the leg support part than in the rear relative position of the support part and thus in the functional position of the leg support part. Said greater angle results in that in the storage position of the leg support part, the effect of the second spring extending into the direction of the second connection straight is particularly important, since the respective force vector in the direction orthogonal relative to the first connection straight becomes comparatively great. As a result of the smaller angle included in the functional position of the leg support part, the respective force vector in the functional position is essentially smaller and thus the effect of the second spring is significantly reduced.

The aforementioned connection straights include an angle of >10°, in particular of >15°, in the front end relative position of the support part and thus in the storage position of the leg support part. In the opposite rear end relative position of the support part and thus the functional position of the leg support part, said angle is preferably less than 10°, in particular preferably less than 5°.

With respect to a pivot movement of the leg support part, it is of particular advantage when starting from a storage position of the leg support part, the pivot movement of the leg support part in the direction of its functional state results in a continuous decrease of the angle between the two connection straights during the first 30° of said movement, mainly within the first 15°.

With respect to the storage position of the leg support part, it is of particular advantage when the second spring is configured such and adjusted to the position of the third and of the fourth coupling point that the spring force of the second spring is at least 20 N. By means of that, the storage position of the leg support part can well be ensured.

Even though a plurality of second springs may be provided, which have identical coupling points with respect to the aforementioned projection plane, it is of advantage that only one such spring is provided which is in particular preferably arranged between two external side wall parts of the base. Thus, in the assembled state of the fitting the spring is hardly visible from the exterior so that the aesthetic appearance of the respective furniture is not interfered.

Preferably, the spring is a helical spring, wherein in particular preferably the length of said helical spring in the relaxed state does not surpass 200 mm, in particular preferably 150 mm.

Besides to the fitting, the invention also relates to an item of seating furniture equipped with such a fitting.

BRIEF DESCRIPTION OF THE DRAWINGS

Further advantages and aspects of the invention result from the claims as well as from the following description of a preferred exemplary embodiment of the invention, which is explained by means of the drawings. Here:

DETAILED DESCRIPTION

Figure 1:
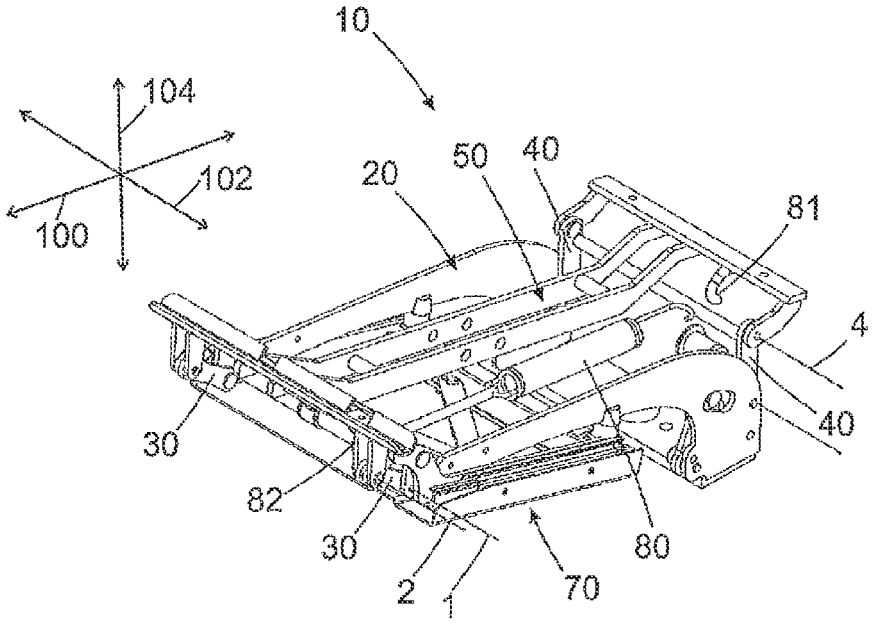
FIGS. 1 and 2 show a furniture fitting according to the invention in a storage position and in a functional position.
Figure 2:
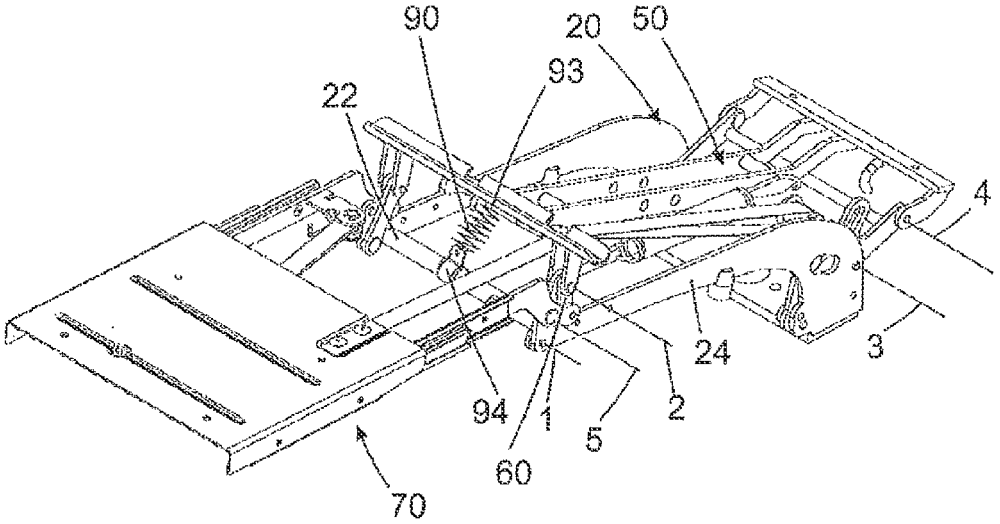

At first, by means of the FIGS. 1 and 2 the essential elements of the fitting and the two positions shown are explained.

The fitting 10 shown comprises a base 20 and front brackets 30 and rear brackets 40 pivotably coupled to said base about a first axis 1 and a third axis 3, respectively. The respective opposite ends of the brackets 30, 40 are pivotably coupled to a support part 50 around a second axis 2 and a fourth axis 4, respectively.

The base is intended to be provided with a furniture foot which allows fixed in position arrangement of the base relative to a ground or the rotatable arrangement of the base relative to a ground. The support part 50 serves for fixation of the seat surface. The base 20, the support part 50, as well as the front brackets 30 and the rear brackets 40 together form a closed catenary of four segments, which are connected to one another via the aforementioned axis 1, 2, 3, 4. By means of the front and the rear brackets 30, 40, a movability of the support part 50 is given, which becomes clear by means of the two positions of FIGS. 1 and 2.

The support part may take a front end position with respect to a furniture longitudinal axis 100, as shown in FIG. 1, and a rear relative end position as shown in FIG. 2. In this case, due to the different lengths of the front and the rear brackets 30, 40, the support part is pivoted. In its rear relative end position of FIG. 2, it is tilted by approximately 12° relative to its orientation in the front end relative position of FIG. 1.

A leg support part 70 pivotably coupled around a pivot axis 5 is adjacent to a front end of the base 20. As can be seen from FIGS. 1 and 2, said leg support part 70 is in a storage position, which is shown in FIG. 1, when the support part 50 is in its front end position. If the support part 50 is in its rear end position, as shown in FIG. 2, the leg support part is in a functional position. In an upholstered form, it may serve as a support for the legs of a person sitting on the item of furniture.

The movement of the leg support part 70 together with the movement of the support part 50 is forced-coupled relative to the base 20. That is achieved in that the leg support part 70 is not only coupled to the base 20 pivotably about the pivot axis 5, but also to the support part 50 by means of an additional bracket 60.

The fitting 10 comprises a first spring 80, the rear first coupling point 81 of which is provided on the support part 50 and the front second coupling point 82 of which is provided to a traverse 22 associated to the base 20. In this context, it is to be noted that due to limitations of the graphical software with which the figures were produced, the first spring 80 seems to be not hooked into its rear coupling point. However, this is true for the assembled state of the fitting.

The first spring 80 is expanded as illustrated in FIGS. 1 and 2, when the support part 50 is displaced into its rear end relative position. Said spring serves to not turn the force application to the support part 50 into an immediate and abrupt transfer of the fitting from the state of FIG. 1 into the state of FIG. 2 as a result of a person sitting down on the seating surface. Instead, said transfer is to be dampened. The first spring 80 is configured to that end. Although the first spring 80 acts such that force is applied to the support part 50 in the direction of its front relative end position of FIG. 1 and that is to cause the pivoting of the leg support part 70 into the storage position of FIG. 1 due to the forced-coupling, the spring force of the first spring 80 is not sufficient to retain the leg support part 70 in the position of FIG. 1. However, a stronger first spring 80 would prevent the functioning of the fitting as a whole.

Therefore, a second spring 90 is provided which extends between a third coupling point 93 on the support part 50 and a fourth coupling point 94 on the traverse 22 of the base part 20. The second spring 90 is arranged centrally with respect to a furniture transverse axis 102, so that it is not visible when the fitting 10 is integrated in a furniture. The aforementioned second spring 90 serves to pull the leg support part 70 in the storage position of FIG. 1. In order to permit that, without—as a result—causing the undesired effect that the second spring 90 aggravates the transfer of the fitting 10 and in particular of the leg support part 70 into its functional position of FIG. 2, a design of the relevant geometrical relations is provided which is explained by means of the lower side illustration of FIGS. 3A and 3B.

Figure 3A:
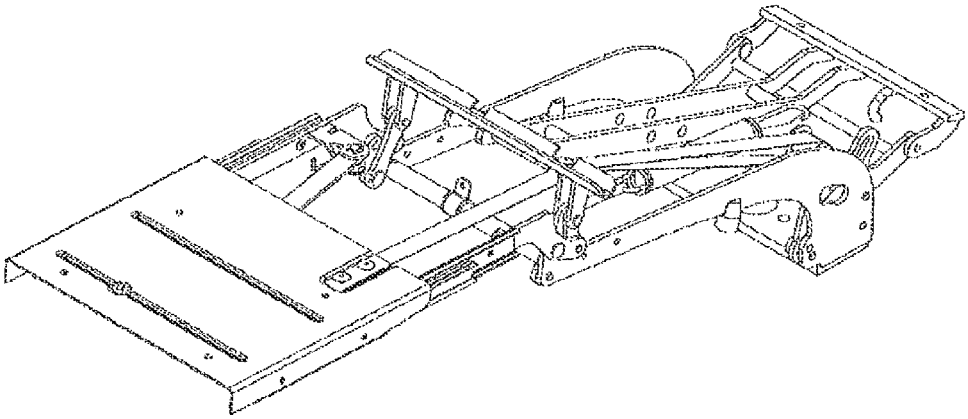
FIGS. 3A to 3H show the fitting of FIGS. 1 and 2 each in a perspective view and in a sectional side view during the transfer from the functional position of FIGS. 3A and 3B into the storage position of FIGS. 3G and 3H.
Figure 3B:
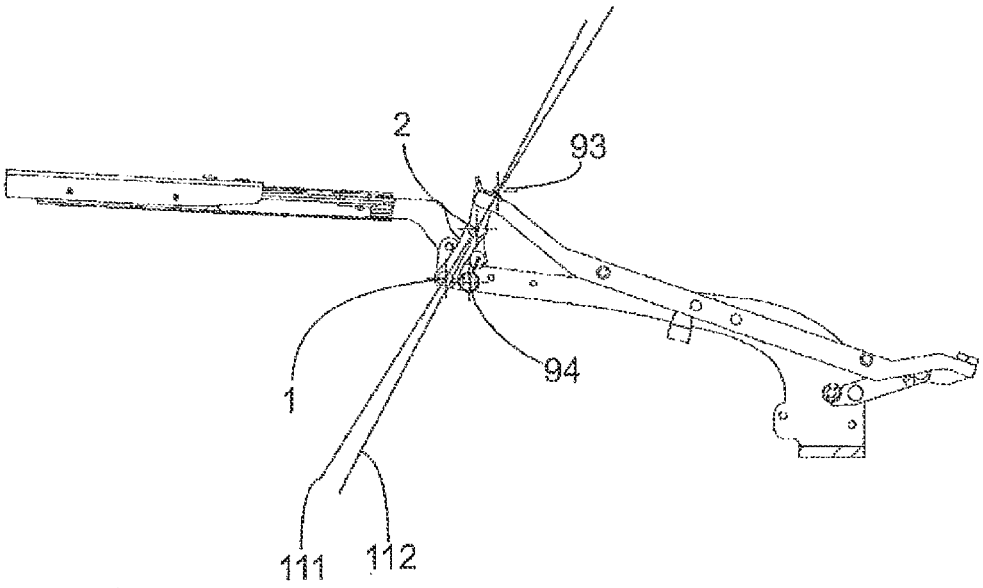
Figure 3C:
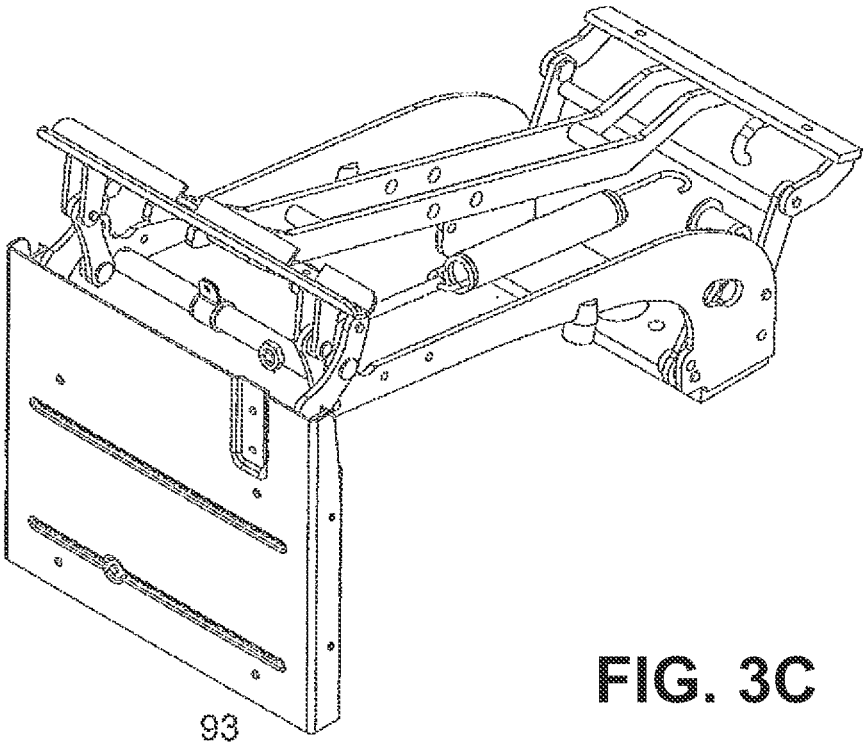
Figure 3D:
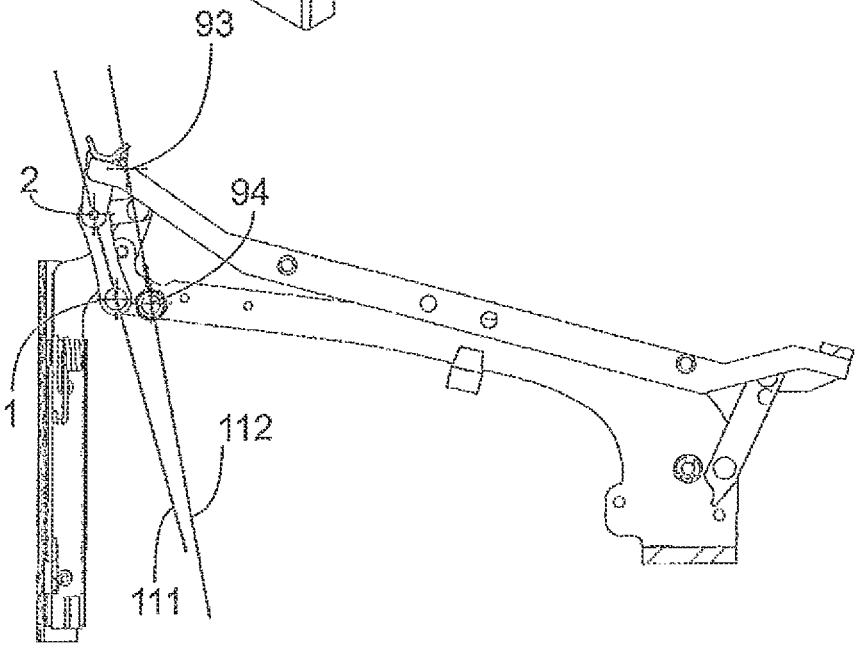
Figure 3E:
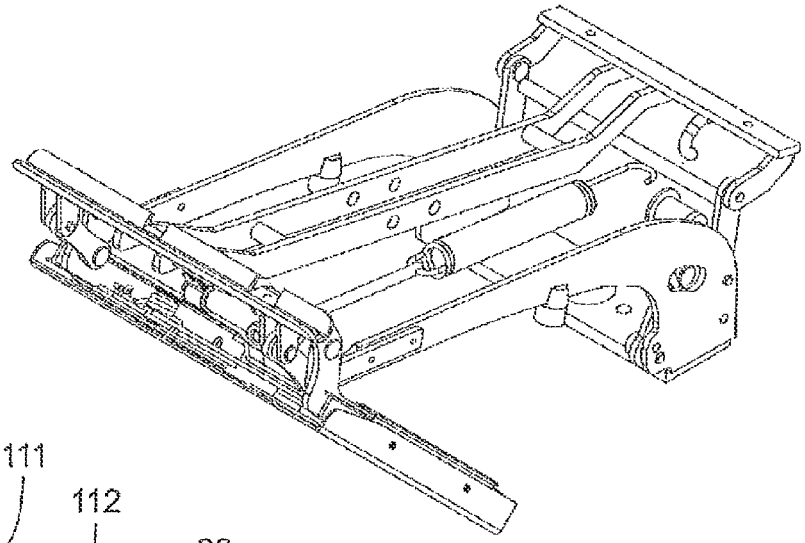
Figure 3F:
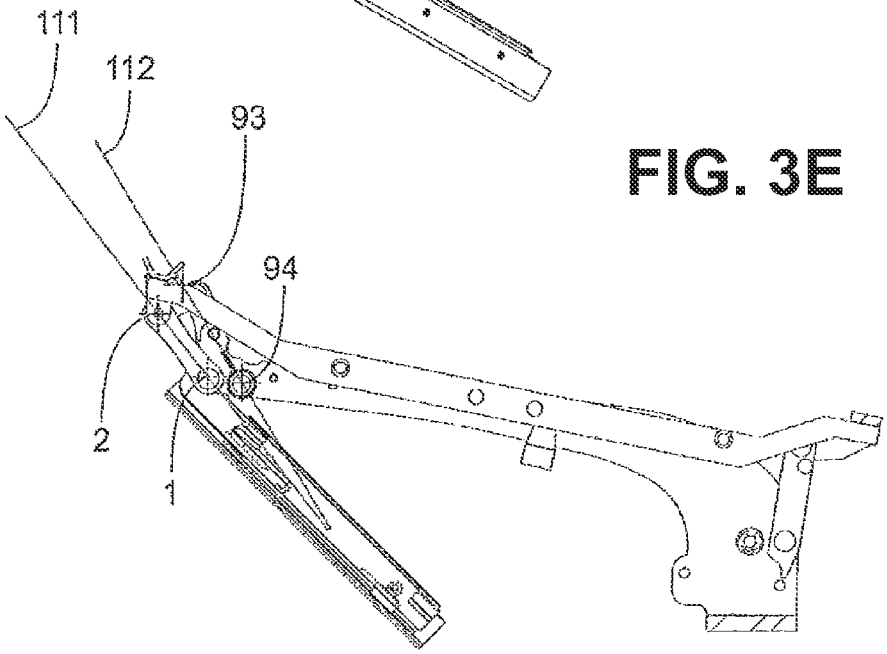

Said lower illustration shows the projection plane mentioned above already, which plane is defined by the furniture vertical axis 104 and the furniture longitudinal axis 100. In FIGS. 3A and 3B the first and the second axis 1, 2 as well as the third coupling point 93 and the fourth coupling point 94 of the second spring 90 are indicated. For a better understanding, the second spring 90 is not shown as in FIGS. 3C to 3H.

Since both the second axis 2 and the third coupling point 93 are provided at the support part 50, they are spaced from one another in the projection plane of FIGS. 3A and 3B, at the bottom, in an unchanged manner, in this case by almost 40 mm. Since also the first pivot axis 1 and the fourth coupling point 94 are provided at a common component, namely the base 20, they are also spaced apart from one another at a constant distance, in this case by approximately 25 mm.

In the embodiment of FIGS. 3A and 3B, in which the leg support part 70 is in its functional state and the support part 50 is in its rear relative end position relative to the base part 20, a first connection straight 111 which crosses the first and second axis 1, 2 and thus represents the orientation of the front bracket 30, is almost parallel to a second connection straight 112 which crosses the coupling points 93, 94 and thus represents the extension of the second spring 90. The angle included between the two straights 111, 112 is significantly smaller than 10°.

Said small angle results in the spring force almost not causing any effect since its force vector parallel to the first connection straight 11 is almost identical to its resulting force vector. The orthogonal force vector actually resulting in an effective force application to the support part 50 relative to the base 20 is comparatively very small.

Figure 3G:
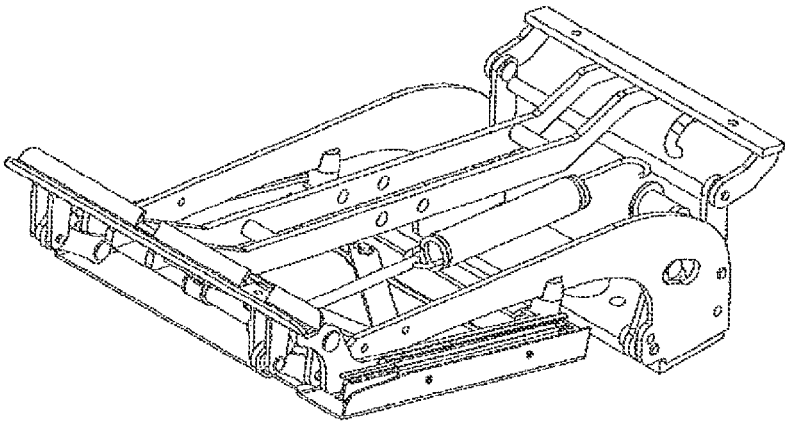
Figure 3H:
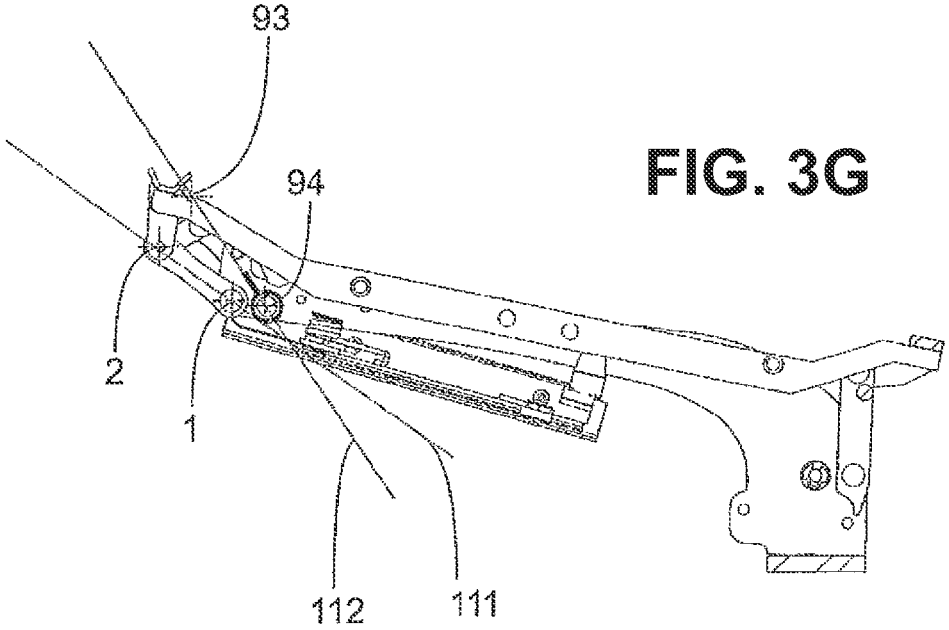

If starting from said starting position of FIGS. 3A and 3B, a transition into the end state of FIGS. 3G and 3H is effected, the leg support part 70 is pivoted at the same time, with respect to FIGS. 3A and 3B at the bottom, counterclockwise, while the support part 50 is displaced forwards with respect to the furniture longitudinal axis 100.

FIGS. 3C to 3F show that this does not result in an increase of the angle included between the connection straights 111, 112 over the major part of the pivot distance of the leg support part 70. Indeed, the included angle gets smaller, at first. However, if the movement of the leg support segment in the direction of its storage position of FIGS. 3G and 3H is continued, said angle gets greater again until reaching its maximum in the storage state of the leg support part 70 in FIGS. 3G and 3H. In said state, the angle is 17°, so that a relevant part of the spring force provided by the second spring 90 is available in the form of a force vector orthogonal to the first connection straight 111. In the state of FIGS. 3G and 3H, said effective part of the spring force of the spring 90 pulls down the support part 50 in the region of its front end, whereby due to the described forced coupling the leg support part 70 is pushed in the direction of the storage position of FIGS. 3G and 3H and is thus reliably secured in said storage position.

In the case that the transition from the storage position of FIGS. 3G and 3H into the functional position of the leg support part 70 of FIGS. 3A and 3B is desired in the opposite direction, the second spring 90 causes a significant effect but over a very small pivot angle of the leg support part 70 of approximately 15°. Upon leaving said pivot region, what approximately corresponds to the state of FIGS. 3E and 3F, the spring 90 performs energetically almost neutral due to the present almost parallel orientation relative to the connection straights 111, 112 and thus does not interfere with the transfer of the leg support part into the functional state of FIGS. 3A and 3B.

The invention claimed is:

1. A fitting for an item of seating furniture, comprising:

a base for fixed-in-position arrangement or rotatably-movable arrangement around a vertical axis on a ground, a support part for a seating surface, which is movable relative to the base between a front end relative position and a rear end relative position, a front bracket and a rear bracket, wherein the front bracket is pivotable relative to the base about a first axis fixed in position to the base and to the front bracket and pivotable relative to the support part about a second axis fixed in position to the support part and the front bracket, and the rear bracket is pivotable relative to the base about a third axis fixed in position to the base and to the rear bracket and pivotable relative to the support part about a fourth axis fixed in position to the support part and to the rear bracket, and a leg support part which is pivotable between a storage position underneath the base and a functional position in front of the base and whose relative position to the base is forcedly-coupled to a relative position of the support part relative to the base such that the leg support part takes the functional position when the support part is arranged in the rear end relative position, and takes the storage position when the support part is arranged in the front end relative position, wherein a first spring is provided between a first coupling point at the support part and a second coupling point at the base part, the first spring causing a first force application to the support part in a direction of the front end relative position, and a second spring is attached to a third coupling point at the support part, the third coupling point being spaced apart from the first coupling point and the second coupling point, the second spring also being attached to a fourth coupling point at the base part, and the second spring, when the leg support part approaches the storage position, acts between the support part and the base part such that a second force is applied to the leg support part in a direction of the storage position.

2. The fitting for an item of seating furniture according to claim 1, wherein the leg support part is operatively coupled to the front bracket such that the leg support part is pivotable in an identical direction as the front bracket relative to the base.

3. The fitting for an item of seating furniture according to claim 1, wherein the third and fourth coupling points of the second spring are arranged such that the second spring is contracted in the front end relative position of the support part as compared to the rear end relative position.

4. The fitting according to claim 1, wherein the third coupling point of the second spring is spaced apart from the second axis.

5. The fitting according to claim 1, wherein the fourth coupling point of the second spring is spaced apart from the first axis.

6. The fitting according to claim 1, wherein the third coupling point is arranged relative to the second axis and the fourth coupling point is arranged relative to the first axis such that in the front end relative position of the support part relative to the base part a first connection straight between the first and the second axis includes an angle >10° with a second connection straight between the third and the fourth coupling point.

7. The fitting according to claim 1, wherein the third coupling point is arranged relative to the second axis and the fourth coupling point is arranged relative to the first axis such that in the rear end relative position of the support part relative to the base part a first connection straight between the first and the second axis includes an angle <10° with a second connection straight between the third and the fourth coupling point.

8. The fitting according to claim 1, wherein the third coupling point is arranged relative to the second axis and the fourth coupling point is arranged relative to the first axis such that a first connection straight between the first axis and the second axis includes a greater angle with a second connection straight between the third coupling point and the fourth coupling point in the front end relative position of the support part than in the rear relative position of the support part.

9. The fitting according to claim 1, wherein the third coupling point is arranged relative to the second axis and the fourth coupling point is arranged relative to the first axis such that starting from the front end relative position of the support part, a displacement of the support part in a direction of the rear end relative position results in that an angle enclosed between a first connection straight between the first axis and the second axis and a second connection straight between the third axis and the fourth coupling point decreases continuously at least over a pivot angle of 30°.

10. The fitting according to claim 1, wherein the third coupling point and the fourth coupling point of the second spring are arranged such that and adjusted to the second spring such that the spring force of the second spring in the front end relative position of the support part is at least 20 Newton.

11. The fitting according to claim 1, wherein the second spring with respect to a transverse direction of the fitting in a direction of the axes is arranged between two external side walls of the base.

12. The fitting according to claim 1, wherein the second spring is configured as a helical spring.

13. The fitting according to claim 1, wherein the base is unitary and rigid.

14. The fitting according to claim 1, wherein a first line between the first coupling point and the second coupling point is not parallel to a second line between the third coupling point and the fourth coupling point.

15. The fitting according to claim 1, wherein the second spring comprises a tension spring.

16. An item of seating furniture having the fitting according to claim 1.

17. An item of seating furniture comprising:

a fitting, the fitting comprising:

a base for fixed-in-position arrangement or rotatably-movable arrangement around a vertical axis on a ground, a support part attached to a seating surface, which is movable relative to the base between a front end relative position and a rear end relative position, a front bracket and a rear bracket, wherein the front bracket is pivotable relative to the base about a first axis fixed in position to the base and to the front bracket and pivotable relative to the support part about a second axis fixed in position to the support part and the front bracket, and the rear bracket is pivotable relative to the base about a third axis fixed in position to the base and to the rear bracket and pivotable relative to the support part about a fourth axis fixed in position to the support part and to the rear bracket, and a leg support part attached to a leg support, the leg support part being pivotable between a storage position underneath the base and a functional position in front of the base and whose relative position to the base is forcedly-coupled to a relative position of the support part relative to the base such that the leg support part takes the functional position when the support part is arranged in the rear end relative position, and takes the storage position when the support part is arranged in the front end relative position, wherein a first spring is provided between a first coupling point at the support part and a second coupling point at the base part, the first spring causing a first force application to the support part in a direction of the front end relative position, and a second spring is attached to a third coupling point at the support part, the third coupling part being spaced apart from the first coupling point and the second coupling point, the second spring also being attached to a fourth coupling point at the base part, and the second spring, when the leg support part approaches the storage position, acts between the support part and the base part such that a second force is applied to the leg support part in a direction of the storage position.

* * * * *